US005106092A

United States Patent [19]

Sedlock

[11] Patent Number: 5,106,092

[45] Date of Patent: Apr. 21, 1992

[54] BINGO WINNING SQUARE INFORMATION APPARATUS

[76] Inventor: Elsie K. Sedlock, 5479 Eden, Dearborn Heights, Mich. 48152

[21] Appl. No.: 747,654

[22] Filed: Aug. 19, 1991

[51] Int. Cl.[5] ..... A63F 3/06; A63F 9/00

[52] U.S. Cl. ..... 273/148 R

[58] Field of Search ..... 273/269, 148 R, 148 A

[56] References Cited

U.S. PATENT DOCUMENTS 2,409,493 10/1946 Jones ..... 273/148 R X
3,984,107 10/1976 Nelson ..... 273/148 A
4,695,057 9/1987 McCullen ..... 273/269

*Primary Examiner*—William H. Grieb

*Attorney, Agent, or Firm*—Charles W. Chandler

[57] ABSTRACT

An apparatus used by bingo players as a reminder of the winning bingo square combinations established at the start of the game. The apparatus includes a small stand placeable on a table surface in front of a bingo player. A number of small informational panels are pivotably supported on the stand so that either the front face or the rear face of each panel can be seen by the player. Winning bingo square information appears on the front face of each panel; the rear face of each panel is left blank. The player can selectively adjust the different panels so that he/she is continually made aware of the potential winning square combinations in effect for the game being played.

10 Claims, 1 Drawing Sheet

BINGO WINNING SQUARE INFORMATION APPARATUS

BACKGROUND AND SUMMARY OF THE INVENTION

This invention relates to an apparatus for facilitating the playing of the game of bingo.

Bingo is a game of chance wherein numbered balls are drawn from a hopper for comparison with numbers appearing on bingo cards purchased by the players. Each bingo card has twenty-four numbered squares plus one free space. The numbered squares are arranged in five columns, with five numbers in each column. As the caller draws each numbered ball out of the hopper, the number is called out to the players. Each player places a disc on each square of the card or cards containing a called-out number. The process is repeated during the course of the game.

The winning player is the person who first covers the called-out numbers in a pre-specified combination of squares on his/her bingo card. Different games can be played simultaneously, e.g. covering the four corner squares, or the six interior squares, or the sixteen outside squares. The caller announces at the start of each game the particular winning square orientations for that game. Each player has to be aware of the possible winning square combinations. However, when a player is playing a large number of bingo cards, he/she may be so busy scanning the cards as to forget which winning combinations remain to be matched.

The present invention is concerned with an apparatus to remind the player of the winning square combinations remaining for a given call of the bingo numbers. The apparatus, in its preferred form, comprises a stand adapted for placement on a table surface facing the player. The stand includes a horizontal axis pivot means for swingably suspending a plural number of panels. Each panel has indicia representing a particular winning bingo square combination, e.g. the four corner squares, or the six interior squares, or the sixteen outside squares.

The number of panels can vary, depending on the different number of winning square combinations commonly used at the particular place where bingo is being played. Typically, there will be three, four or five panels. Each panel can be swung around its pivot suspension axis so that either face of the panel is presented to the bingo player.

At the start of a bingo game, the caller announces which winning square combinations will be in effect for that game. At that time, the player turns the panels so that the panel faces with the appropriate indicia are presented for his/her viewing; the other panels are turned so that their blank faces are viewable.

During the course of the game, the player can periodically glance at the array of panels to quickly remind himself or herself of the winning square combinations remaining for that game. As someone bingos one of the winning square combinations, e.g. the four outside corners, the panel having that winning square indicia thereon is turned so that its blank face comes into view. The player thus is able to better focus on the remaining winning square combinations. The panels are reset at the start of each game.

U.S. Pat. No. 4,695,057 to C. McCullen represents a prior art attempt at facilitating the playing of the game of bingo. The patent discloses a system of templates having various different orientations of cut outs mated to the squares on bingo cards. A selected template is placed over each card (or group of cards) so that only a particular orientation of squares is visible or highlighted.

The template placed over a bingo card induces the player to focus on a particular orientation of winning squares. However, the template is only useful when the game involves a single winning square combination. When the game involves multiple winning square combinations, the template might actually prove a detriment because it could mask or obscure a winning square combination. The apparatus of the present invention is believed to be a patentable departure from the template concept disclosed in U.S. Pat. No. 4,695,057.

THE DRAWINGS

DESCRIPTION OF A PREFERRED EMBODIMENT OF THE INVENTION

Figure 1:
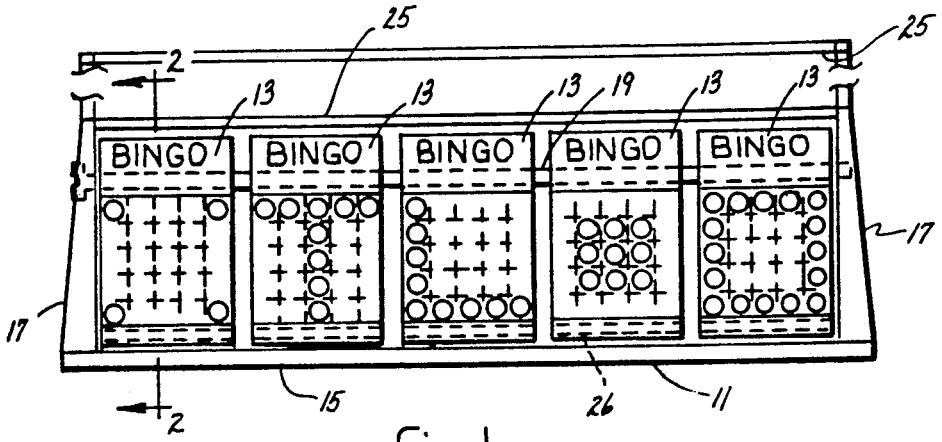
FIG. 1 is a front elevational view of an apparatus embodying the invention.

FIG. 1 shows an apparatus that includes a stand 11 for swingably supporting five rectangular panels 13. Each panel has the same structural configuration, except that different indicia are printed on the different panels.

Figure 2:
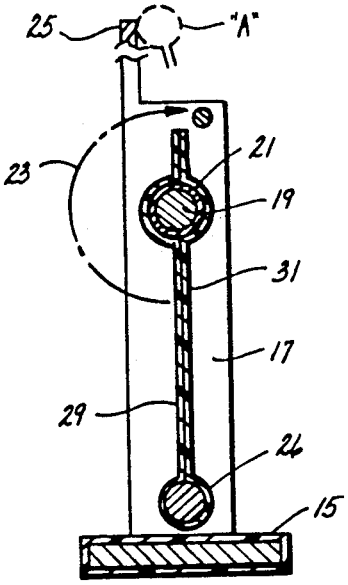
FIG. 2 is an enlarged sectional view on line 2—2 in FIG. 1.

Stand 11 comprises a flat base 15 and two upstanding arms 17. A pivot rod 19 extends between arms 17 directly above base 15. As shown in FIG. 2, a representative panel 13 comprises a semi-rigid plastic sheet doubled back on itself to define a two ply laminated panel. The laminations are bonded to a cylindrical sleeve 21 that encircles pivot rod 19. The sleeve serves as a trunnion to permit the panel to swing around the rod 19 axis, as indicated by arrow 23 (FIG. 2). A horizontal metal bar 25 of a magnetically-attractive material, is supported between arms 17.

At its lower end, each panel 13 carries a permanent magnet 26. The weight of the magnet acts as a pendulum to normally keep the panel in a vertical orientation, as shown in FIG. 2.

Bar 25 is disposed at a height to attract magnet 26 when the panel is raised. Bar 25 retains the panel in the upright position when the lower panel edge engages bar 25, as shown in phantom, lines at "A" in FIG. 2.

Each panel 13 has a front face 29 and a rear face 31. The front face has printed indicia representing a particular type of winning bingo square combination. As shown in FIG. 1, the printing depicts a replica of a bingo card, with circles in selected squares representing the disks commonly used to cover called-out numbers. The combinations of the circles on the different cards represent winning cards. The illustrated panels depict four corners, or a T, or an L, or the six interior squares, or the sixteen outside squares. Other winning square combinations can be provided to meet different game conditions.

Only the front face of each panel has indicia representing a particular winning bingo combination. The rear face of each panel is left blank. The apparatus is placed on a table surface in front of the bingo player. At the start of each bingo game the player selectively positions each panel 13 in either the FIG. 2 position (with face 29 presented to the player) or a reversed position resting against bar 25 (with face 31 presented to the player). The selection is made according to the particular winning square combinations announced by the bingo caller at the start of the game. During the course of the game, the player can glance at the panels to remind himself/herself of the winning square combinations required in order to bingo. As persons in the audience bingo any particular winning square combination, the corresponding panel is reversed so that its rear face 31 is presented to the player. With the updated information, the player is better enabled to concentrate on the remaining winning combinations.

Pivot rod 19 is preferably detachably connected to arms 17 in order to permit the panels to be changed to meet different game conditions. The right end of the rod can be threaded to thread into a threaded opening in the rightmost arm 17. A screwdriver slot can be provided in the left end of the rod.

Figure 3:
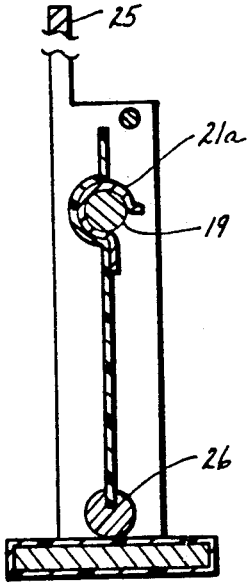
FIG. 3 is a view taken in the same direction as FIG. 2, but illustrating a different apparatus embodying the invention.

FIG. 3 shows a variant of the invention wherein pivot rod 19 is non-removable. In this case the trunnion means on each panel comprises a spring clip 21*a* bonded to the panel. The clip partially encircles rod 19 to provide a rotary connection between the panel and the rod. However, the clip can be spread apart slightly to remove or replace the panel. I major respects, the FIG. 3 arrangement is similar to the arrangement of FIGS. 1 and 2.

Figure 5:
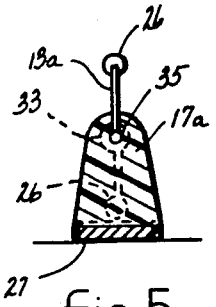
FIG. 5 is a transverse sectional view taken on line 5—5 in FIG. 4.
Figure 4:
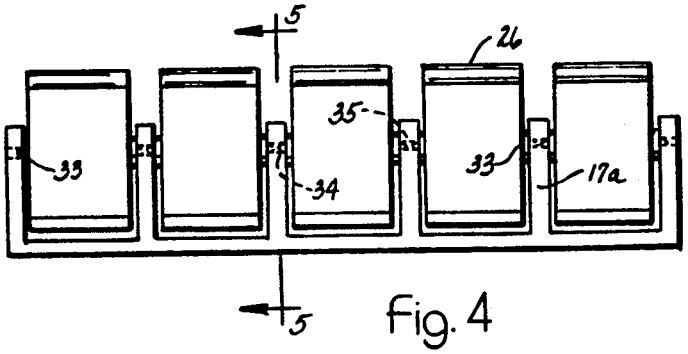
FIG. 4 is a front elevational view of another apparatus constructed according to the invention.

FIGS. 4 and 5 show another arrangement under the invention, wherein the panel pivot means takes the form of circular disks 33 carried by each side edge of each panel. A hemi-spherical projection 34 extends from each disk into a circular opening 35 in an upstanding support arm 17*a*. With the illustrated arrangement, each panel 13*a* can be freely swung around the horizontal pivot axis defined by holes (openings) 35. The panels can be selectively removed from the stand by snapping the projections 34 out of holes 35.

The first and second edges of each panel 13*a* are located equidistant from the pivot axis. A second permanent magnet 26 can be located on the second edge of each panel 13*a* for magnetic linkage with the magnetically attractive base 25.

Each panel in the FIG. 4 arrangement has a front face printed with a different winning square combination. The rear face of each panel is blank. The apparatus is used in the same fashion as the FIG. 1 apparatus.

Figure 6:
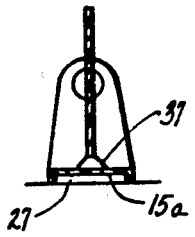
FIG. 6 is a sectional view taking through a further structure of the invention.

FIG. 6 shows a variant of the FIG. 4 apparatus, wherein each panel is releasably retained in a selected position by means of a notch-type detent 37 molded as an integral part of base 15*a*. Each panel can be turned to a position wherein either one of its end edges enters into the detent notch.

The drawings show the apparatus as having five informational panels. However, a lesser number of panels can be used. In most situations at least three panels would be used.

The size of the apparatus can be varied in accordance with the need for easy viewing of the circles on the front face of each panel. Each panel can be a replica of a bingo card, but on a smaller scale. Typically the apparatus will have a height of about two or three inches.

It will be appreciated that the drawings are representative of the invention, and that changes can be made while still practicing the invention.

I claim:

1. An apparatus for use by a bingo player to remind the player of the types of bingo games being played during a given call of the bingo numbers; said apparatus comprising an upright stand adapted for placement on a table surface facing the bingo player, said stand comprising a base and a horizontal pivot means located directly above said base; and a plural number of similarly configured panels individually swingably mounted on said pivot means for swinging motion normal to the panel plane; each panel having a first face and a second face; the first face of each panel having indicia thereon representing a particular type of winning bingo square combination; each panel being individually swingable between a first condition wherein the first face is presented to the bingo player, and a second condition wherein its second face is presented to the bingo player.

2. The apparatus of claim 1, and further comprising means for releasably retaining each panel in its first condition or its second condition.

3. The apparatus of claim 2, wherein each panel has first and second edges thereof extending parallel to the pivot axis, said retaining means comprising a strip of magnetically permeable material located in said base, and a permanent magnet located on said first edge of each panel, whereby each panel can be moved to a position wherein its permanent magnet is magnetically linked to the magnetically-attractive base.

4. The apparatus of claim 3, wherein said first and second edges of each panel are located equidistant from the pivot axis.

5. The apparatus of claim 4, and further comprising a second permanent magnet located on said second edge of each panel for magnetic linkage with the magnetically-attractive base.

6. The apparatus of claim 1, wherein the number of swingable panels is a minimum of three panels and a maximum of five panels.

7. An apparatus for use by a bingo player to remind the player of the types of bingo games being played during a given call of the bingo numbers; said apparatus comprising an upright stand adapted for placement on a table surface in front of a seated bingo player; said stand comprising a base, two spaced upstanding arms extending upwardly from said base, and a horizontal pivot rod extending between said arms directly above the base; and a plural number of similarly configured panels suspended from said horizontal pivot rod; each panel having an arcuate trunnion means at least partially encircling said pivot rod whereby each said panel can be manually swung around the pivot rod axis; each panel having a first face and a second face; the first face of each panel having indicia thereon representing a particular type of winning bingo square combination; each panel being individually swingable between a first condition wherein its first face is presented to the bingo player, and a second condition wherein its second face is presented to the bingo player.

8. The apparatus of claim 7, wherein each panel has first and second edges thereof extending parallel to the pivot rod axis; each said first edge being relatively near to the pivot rod axis, and each said second edge being relatively far away from the pivot rod axis.

9. The apparatus of claim 7, wherein there are at least three panels but no more than five panels.

10. The apparatus of claim 7, wherein each panel is considerably smaller than a conventional bingo card.

* * * * *